United States Patent [19]

Bakshi et al.

[11] Patent Number: 5,027,887

[45] Date of Patent: Jul. 2, 1991

[54] CONTINUOUS CASTING LUBRICATION SYSTEM

[75] Inventors: Ian A. Bakshi, Vancouver; Alan C. Perri, Delta; Roy P. Smith, Islington; James K. Brimacombe, Vancouver; Indira V. Samarasekera, Vancouver, all of Canada

[73] Assignee: The University of British Columbia, Canada

[21] Appl. No.: 507,250

[22] Filed: Apr. 10, 1990

[51] Int. Cl.[5] ..... B22D 11/07

[52] U.S. Cl. ..... 164/472; 164/268

[58] Field of Search ..... 164/472, 268

[56] References Cited

U.S. PATENT DOCUMENTS

| | | | |
|---|---|---|---|
| 3,286,309 | 11/1966 | Brondyke | 164/472 |
| 3,446,267 | 5/1965 | Gricol et al. | 164/268 |
| 3,448,788 | 6/1969 | Keene et al. | 164/268 |
| 3,533,462 | 10/1970 | Crowell | 164/268 |
| 3,556,197 | 1/1971 | Foye | 164/268 |
| 4,078,600 | 3/1978 | Cashdollar, Sr. | 164/472 |
| 4,103,732 | 8/1978 | Habert | 164/472 |
| 4,699,200 | 10/1987 | Sedlacek | 164/268 |

FOREIGN PATENT DOCUMENTS

| | | | |
|---|---|---|---|
| 57-50250 | 3/1982 | Japan | 164/472 |
| 234624 | 11/1969 | U.S.S.R. | 164/472 |

*Primary Examiner*—Richard K. Seidel
*Assistant Examiner*—Rex E. Pelto
*Attorney, Agent, or Firm*—C. A. Rowley

[57] ABSTRACT

A system for delivering fluid lubricant to the surfaces of the sidewalls of a mold of a continuous casting machine is provided by a continuously surrounding lubrication gap connecting a manifold to the sides of the casting mold. The lubricating gap has substantially the same resistance to flow between the manifold and the adjacent side of the mold cavity of the mold around the complete perimeter of the mold cavity and has significantly higher resistance to flow of lubricant from the manifold to the mold cavity than the resistance to flow around the manifold and into the gap, whereby the lubricant is uniformly distributed to all the walls of the mold. Preferably the gap will be divided into discrete passages, one for each side of the mold cavity by means of a shaped spacer which also defines the height of the gap and thereby the height of each of the passages. Each passage will normally be of substantially constant width corresponding substantially to the length of the adjacent side of the mold cavity.

15 Claims, 6 Drawing Sheets

CONTINUOUS CASTING LUBRICATION SYSTEM

FIELD OF THE INVENTION

The present invention relates to a lubricating system for a continuous casting mold, more particularly the present invention relates to lubricating system for delivering lubricant at a substantially uniform flow rate around the full perimeter of the mold.

BACKGROUND TO THE PRESENT INVENTION

In the continuous casting of steel billets uniform distribution of lubricant (oil) to all sides of a mold and in the proper amount is essential to insure good surface quality of the resultant casting. Insufficient supply or inadequate distribution of the lubricant may cause the steel shell near the meniscus to stick to the surface of the mold (generally made of chrome plated copper) which causes the billet being formed to be suspended momentarily in the mold and necessitates increased withdrawal forces which, in many cases, gives rise to transverse cracks and deterioration of the billet quality. On the other hand an excess supply of lubricating oil has been linked to hydrogen entrapment and pin hole formation in the billet.

Various techniques for delivering lubricant to the mold have been devised and some are currently in use, however none correlate the flow resistances through the system to insure proper distribution and uniform flow to the mold around substantially the complete perimeter of the mold.

U.S. Pat. No. 3,446,267 issued May 27, 1969 to Gricol et al discloses a system for lubricating a rectangular mold and incorporates a gap composed of a plurality of passages flaring in the direction of flow to the mold perimeter. Each flaring passage is connected with a source of lubricating fluid under pressure to deliver the lubricant to the mold. U.S. Pat. No. 3,448,788 issued June 10, 1969 to Keene et al is similar to the Gricol et al patent. It will be apparent that the resistance to flow decreases in the flaring passages leading to the mold in each of these two systems due to the increasing width of the gap passages as they approach the molds. Uniform distribution of lubricant along the full length of any side wall of the mold is dependent on the lateral expansion of the flow of lubricant. Such lateral expansion is substantially uncontrolled and thus cannot be insured and leads to non-uniform distribution of lubricant.

U.S. Pat. No. 3,556,197 issued Jan. 19, 1971 to Foye illustrates another system for lubricating a mold, this device is not for a process equivalent to the casting process for which the present invention is intended, but utilizes a gasket to define the passages interconnecting a manifold to a gap. The device of this patent will not provide the uniform distribution obtainable with the present invention.

Lubricating system currently used in the industry incorporates a pair of plates having opposed surfaces to define the lubricating gap leading to the molding passage around the complete circumference of the mold. The height of the gap and thus the cross sectional area of the gap is large particularly in relation to the cross section of the manifold supplying lubricant to the gap and results in relatively poor distribution of lubricating oil around the circumference of the mold.

BRIEF DESCRIPTION OF THE PRESENT INVENTION

It is an objective of the present invention to provide a lubricating system for substantially uniformly distributing lubricating fluid (oil) to all of the side walls of mold for continuous casting of billets.

Broadly the present invention relates to a device for delivering lubricating fluid uniformly along the length of each of four sides defining the perimeter of a mold cavity of continuous casting mold of substantially rectangular cross section (or square) comprising means defining a first annular surface encircling said mold cavity and extending substantially perpendicular to a longitudinal axis of said mold a second annular surface in spaced facing relationship to said first surface and cooperating with said first surface to define therebetween an annular lubricant gap surrounding and opening into said mold cavity around substantially the complete circumference of said mold cavity, an annular manifold spaced from and surrounding said mold cavity, an annular flow passage means symmetrically positioned around and equally spaced from said mold cavity so that the length of said gap between said annular flow passage means and said mold cavity is substantially constant, said flow passage means connecting said manifold with said lubricant gap for delivery of lubricant into said gap from said manifold on all sides of said mold cavity, said gap having a resistance to flow of lubricant significantly greater than the resistance to flow in said manifold and through said annular flow passage means from said manifold into said gap, said gap passage between said flow passage means and said mold having substantially equal resistance in the direction of lubricant flow around substantially the full perimeter of said mold cavity whereby said lubricant is substantially uniformly distributed around the full perimeter of said mold cavity.

Preferably said first surface forms a surface of a first annular element, said second surface forms a surface of a second annular element and a shaped spacer determines the spacing between said first and second surfaces and thereby the height of said lubricant gap.

Preferably said shaped spacer will be a gasket interposed between said first and second elements.

Preferably said gasket defines said flow passage means between said manifold and said lubricant gap is shaped to divide said lubricant gap into four separate lubricant passages one extending to each said side defining the perimeter of said mold cavity, each said lubricant passage having a width equivalent to substantially the full cross sectional length of its respective of said sides.

Preferably said first and said second surfaces are planar surfaces and are substantially parallel so that the height of said gap is substantially constant between said manifold and said mold cavity.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
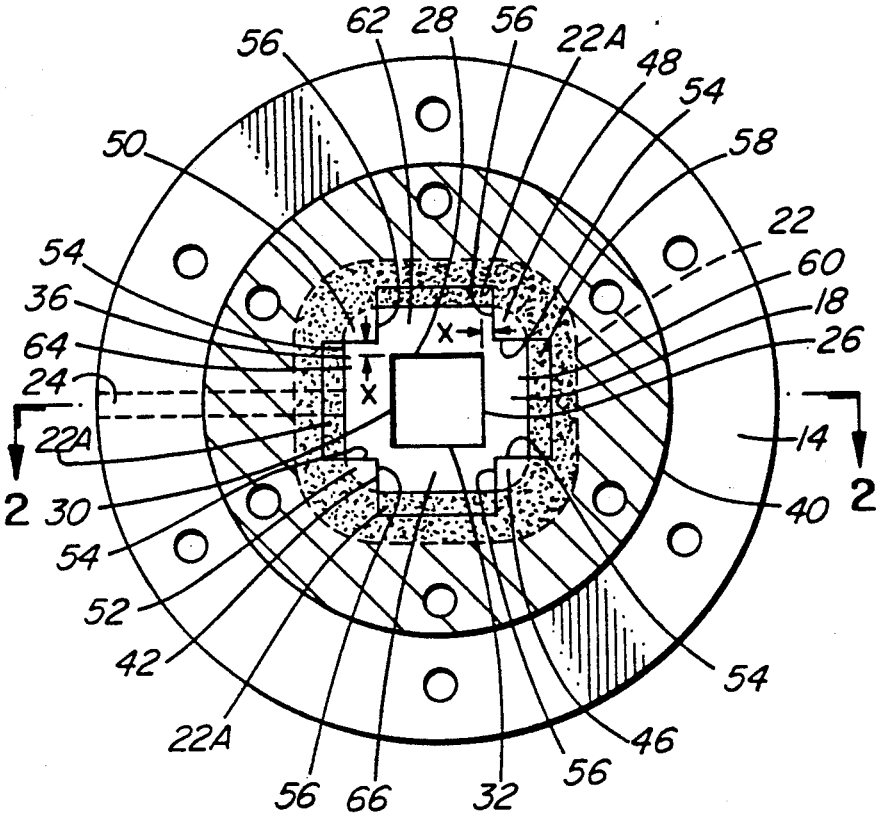
FIG. 1 is a section along the line 1—1 of FIG. 2 illustrating a lubricant distribution system incorporating the present invention.
Figure 2:
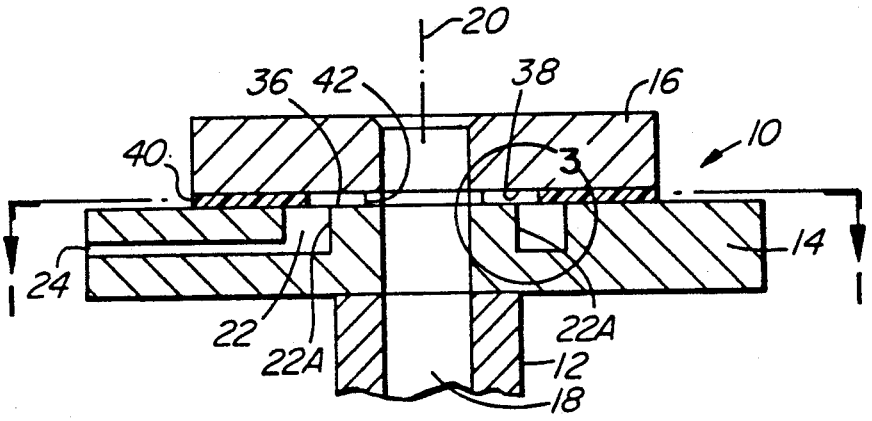
FIG. 2 is a section on the line 2—2 of FIG. 1.

Referring to FIGS. 1 and 2 the lubricating system 10 of the present invention is mounted on the top of a mold 12 for a continuous casting system. The system 10 is composed of a pair of annular plate elements 14 and 16. The mold 12, plate element 14 and plate element 16 are secured together in axial alignment by any suitable means. The axial passages through mold 12 and plates 14 and 16 are substantially identical in cross section and are axially aligned to define a mold cavity 18 having a longitudinal axis 20.

The plate element 14 is provided with an annular cavity which defines an annular manifold 22 spaced from and extending circumferentially around the complete circumference of the mold 18 (see the dotted area in FIG. 1). The manifold is substantially concentric with the longitudinal axis 20 and is formed by interconnected passages each of which is substantially parallel to and extends for a length substantially equal to the cross sectional length of its respective adjacent side wall of said mold 18. The manifold 22 is connected to a suitable source of lubricant such as lubricating oil (not shown) via the passage 24.

The cavity 18 in the illustrated arrangement has a substantially square cross section measured perpendicular to the longitudinal axis 20 and is adapted to form a billet with a square cross section but molds with other cavity shapes may be used to form billets having different cross sections. In the illustrated arrangement the side walls of the cavity 18 have been indicated at 26, 28, 30 and 32 and all have the same length measured in a plane perpendicular to the axis 20 however as above indicated the lengths of these walls may be different to change the shape of the resultant billet. Such changes may necessitate changes to the delivery gap lubricating system to be described below.

The manifold 22 opens onto a first substantially planar surface 36 which is formed on the element 14 and is substantially perpendicular to the axis 20. The first surfaces 36 cooperates with a second substantially planar surface 38 which is formed on the second element 16 but is also substantially perpendicular to the axis 20. The surfaces 36 and 38 are in facing relationship but space by a distance H (FIG. 3) which is determined by the thickness a gasket 40 interposed between the two elements 14 and 16. These surfaces define between them a lubricant gap 42 that extends from the manifold 22 to the cavity 18 and connects each of the sides 26, 28, 30 and 32 of the cavity 18 with the manifold 22. A flow passage 44 from the manifold into the gap 42 is defined by the shape and size of the gasket 40 and the edge of the manifold closest the cavity 18. In the arrangement illustrated the width W of the flow passage 44 is only a portion of the width of the manifold 22 the size of which is determined by the width R and the depth D (see FIG. 3).

The side 22A of the manifold 22 which determines one side of the flow passage 44 is substantially parallel to the adjacent side of the passage 18 so that the length L (FIG. 3) of the gap 42 is substantially the same to all sides of the cavity 18.

In one specific embodiment of the invention applied to a mold having a 4½ inch square cavity the dimensions in inches were as follows $D=0.5$; $W=0.25$; $R=1$; $L=0.5$; and $H=0.015$. The ratio $D\times R/H\times L$ should be large preferably in the order of at least 50 to 1.

In some instances the flow passage 44 may extend substantially uninterrupted completely around the circumference of the mold cavity 18, however, it is preferred, to shape the gasket 40 as shown in FIG. to include 4 triangular projections or ears as indicated at 46, 48, 50 and 52. The ears are substantially right angular projections each having its apex adjacent to the intersection of two adjacent sides of the cavity 18. For example the projection 46 (only one of the projections will be described since all are essentially the same) is formed with a side edge 54 that is substantially parallel to the side 32 of the mold cavity 18 and with a second side 56 that is perpendicular to the side 54 and substantially parallel to the side 26 of the mold cavity 18. The other projections 48, 50 and 52 have their sides 56 substantially parallel to the side 56 of the projection 46 and the sides 54 of all the projections similarly are all substantially parallel. Each pair of adjacent sides 54 or 56 on adjacent projections define the sides of substantially uniform width lubricant gap passages from the manifold 22 to the adjacent side of the cavity 18. The uniform width lubricant gap passage is connected to the manifold 22 via a flow passage 58 (a portion of the flow passage 44) having a dimension substantially equal to the width of the lubricant gap passage to which it is connected.

Thus in the preferred embodiment of the present invention flow of coolant to the corners of the cavity 18 from the corners of the manifold 22 is impaired, and the gap 42 is divided into discrete lubricant gap passages 60, 62, 64 and 66 opening onto the sides 26, 28, 30 and 32 respectively of the mold cavity 18, by the triangular ears 46, 48, 50 and 52. Each of these discrete gap passages 60, 62, 64 and 66 has a width substantially equal to the length of its respective adjacent side of the mold cavity 18 and communicates with a flow passage 58 that is substantially the same width as the gap passage to which it connects. Each of the passages 58 is substantially rectangular and in the illustrated arrangement has its longer sides one of which is defined by the wall 22A of the manifold 22 substantially parallel to its adjacent side of mold cavity 18 so that the length L of each gap passage 60, 62, 64 and 66 measured between its respective passage 58 and the respective wall of the mold cavity 18 to which it connects is substantially uniform and the lengths of all the gap passages 60, 62, 64 and 66 are essentially the same thereby insuring the resistance in the direction of flow of each of these passages is substantially the same.

The gap passages 60, 62, 64 and 66 impose a greater resistance to flow than the manifold 22 and the passages 24 and 58 and thus produce a back pressure in the system when lubricant is fed thereto at the required rate. This relative sizing of the gap passages and the flow paths leading thereto insures that lubricant is uniformly fed to the side walls 26, 28, 30 and 32 since the flow to each of the gap passages is in proportion to the size of its inlet 58 which in turn is determined by the width and length L of the passages (measured perpendicular to the width.) The length L is constant and the widths are respectively equal to the width of the respective gap passage 60, 62, 64 and 66 to which it connects. Thus the flow from the manifold 22 is uniformly distributed along the full width of each of the gap passages and flows in substantially straight line along its respective gap passage 60, 62, 64 and 66 to the adjacent side 26, 28, 30 and 32 respectively of the cavity 18.

In the arrangement illustrated in FIG. I the width of the passages 60, 62, 64 and 66 has been shown as slightly wider than the length of its respective side wall (by the distance 2X) so there is a slight overlap of flows from adjacent gap passages. Provided this overlap is maintained relatively small for example $X=\frac{1}{8}$ inch no problems have been encountered. On the other hand it is preferred not to make the width of the passages 60, 62, 64 and 66 significantly less than the length of their respective sides 26, 28, 30 and 32 respectively.

Figure 1A:
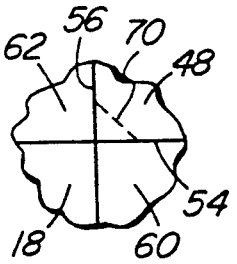
FIG. 1A is a partial plan view illustrating one corner of a mold having a gasket constructed in accordance with a preferred embodiment of the invention.

Generally the width of the passages 60, 62, 64 and 66 will be substantially equal to the lengths of their respective adjacent sides 26,28. 30 and 32 respectively of the mold cavity 18 (see FIG. 1A.) In the arrangement shown in FIG. 1A the point of the projection 46, 48, 50, and 52 coincides with the intersection of the adjacent side of the cavity 18 however the projections may be truncated as indicated by the dotted line 70 so that the points of the gasket does not approach as closely the cavity 18.

Figure 3:
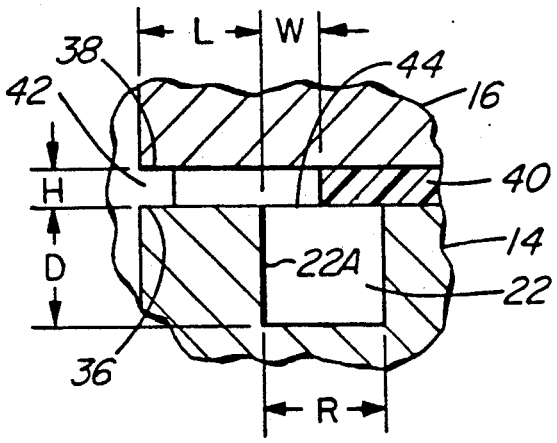
FIG. 3 is an enlarged view of the area in the circle 3 of FIG. 2.

Test of the pressure distribution of the lubricating oil flow using the preferred embodiment of the present invention i.e. the gasket provided with ears to divide the gap 42 into a plurality of discrete gap passages (one for each side of the mold cavity as shown in FIG. 1, 2 and 3) was compared to a prior art distribution system (small cross section manifold) using the conventional gasket (thicker—thickness 0.038 inch) and using a gasket having the same thickness (thickness 0.020 inch) as used with the preferred embodiment. The results of these test are illustrated graphically in FIG. 4, the numerals 1, 2, 3 and 4 represent the different sides of the mold.

The prior art system using the conventional thickness gasket (bars at the extreme right of FIG. 4) provided a very low back pressure varying from a maximum of about 70 Pa to a low of about 30 Pa and thus a very uneven pressure distribution having over 100% variation. When the thick gasket was replaced by a thinner gasket (0.02 inch as used also in the preferred embodiment) the maximum back pressure was still low (maximum of about 343 Pa), but the pressure distribution was substantially the same on all sides with the exception that the bar indicating pressure for side 1 was slightly lower than the others but only by less than 10% (see the middle graphs in FIG. 4.)

Figure 4:
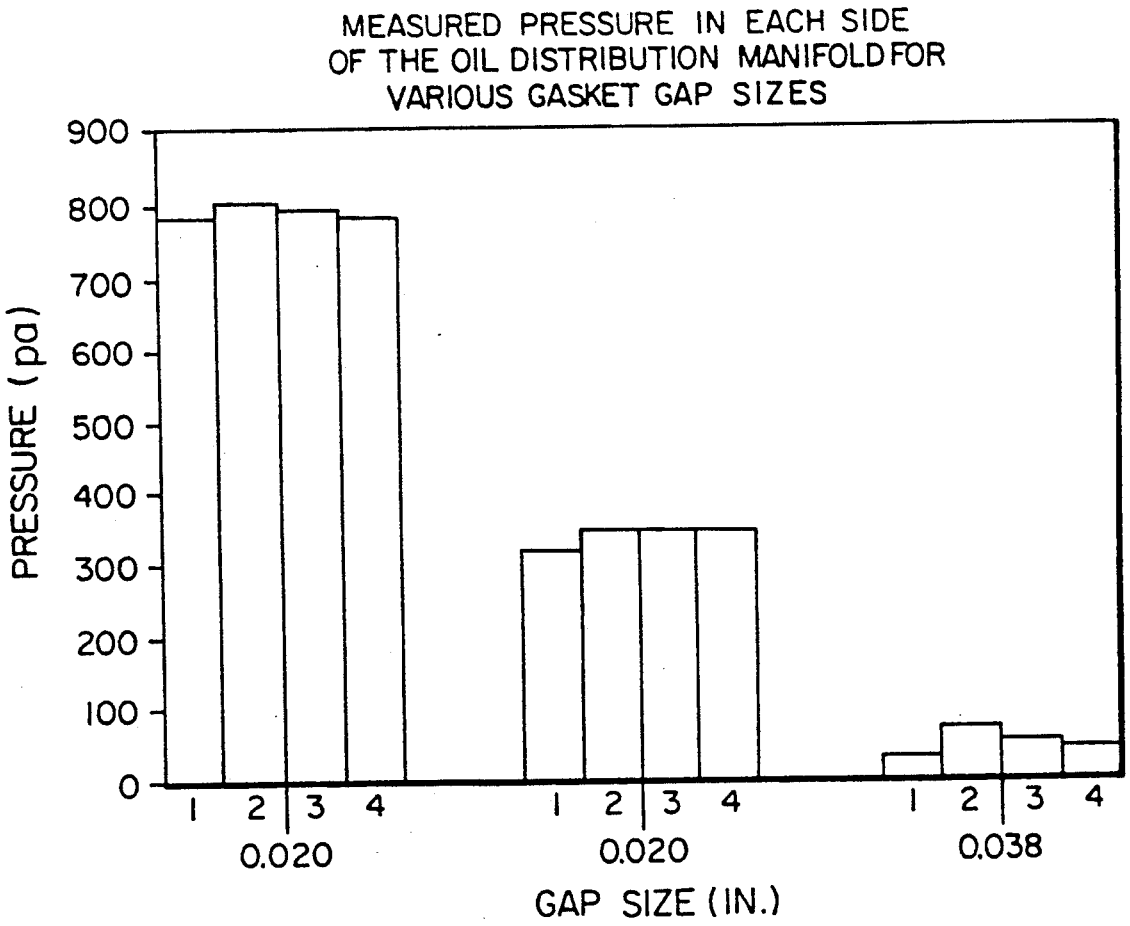
FIG. 4 shows bar graphs of back pressure measured on each side of the oil distribution manifold for two different gap sizes and the preferred embodiment of the present invention.

When the preferred embodiment of the present invention was used incorporating the gasket with ears i.e having an opening in the form of a cross (the "Red Cross" gasket), the results were as illustrated in the left hand bar graphs in FIG. 4. The pressure was significantly higher (just below about 800 Pa), over twice as high as the pressure when the thinner gasket was used as illustrated in the middle graphs and the differential in pressure was a maximum of about 2.5%.

In FIGS. 5 to 12 the numerals 1 to 24 inclusive indicate uniformly space locations around the periphery of the mold and the locations 1,7,13 and 19 represent the corners of the mold. In the tests the amount of fluid collected in the corners was divided by two to provide the bar data since the collectors in the corners collected fluid over twice the length of the periphery of the mold than the other collectors. Also in each of the tests specifying a conventional thick gasket the gasket was 0.036 inches and the conventional thin gasket was 0.02 inches and the gaps between the plates varied accordingly. The modified thick and thin gaskets of the "red cross" shape of the present invention were 0.032 inches and 0.016 inches respectively (0.02 and 0.016 inch thick gaskets perform substantially equivalently.)

Figure 5:
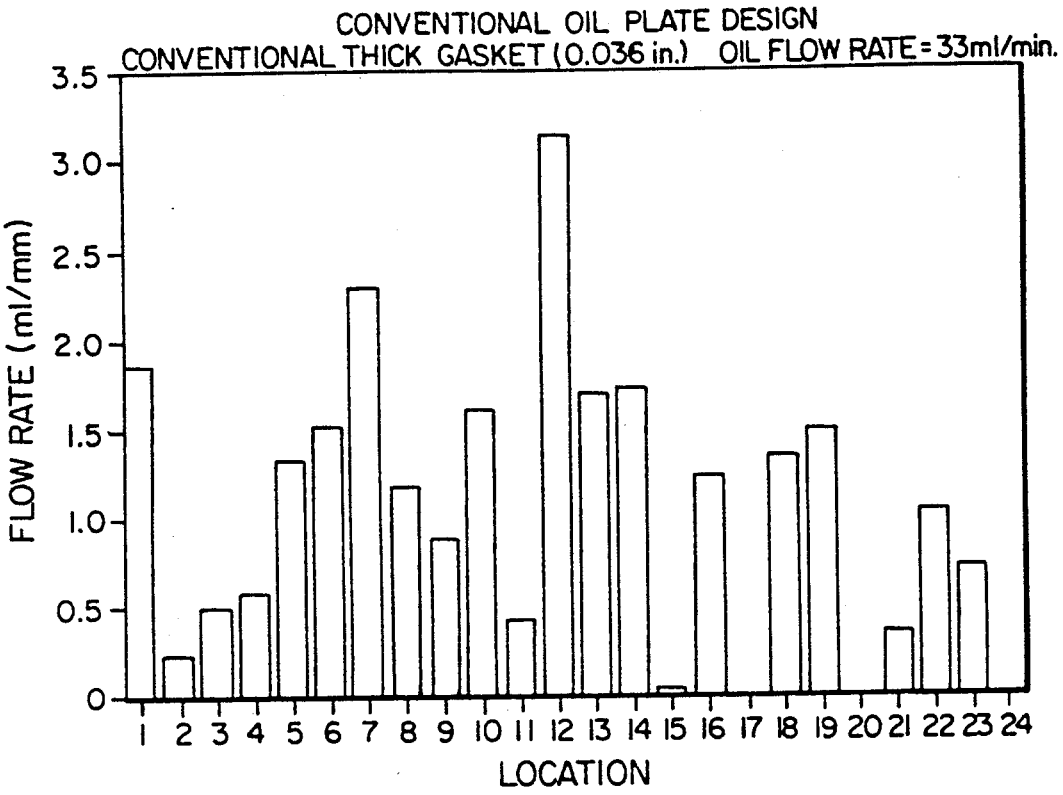
FIGS. 5 to 8 are bar graphs showing the measured flow rates using a conventional plate design as used in the prior art in combination with different thicknesses of a conventional gasket and of a gasket modified in accordance with the present invention.
Figure 6:
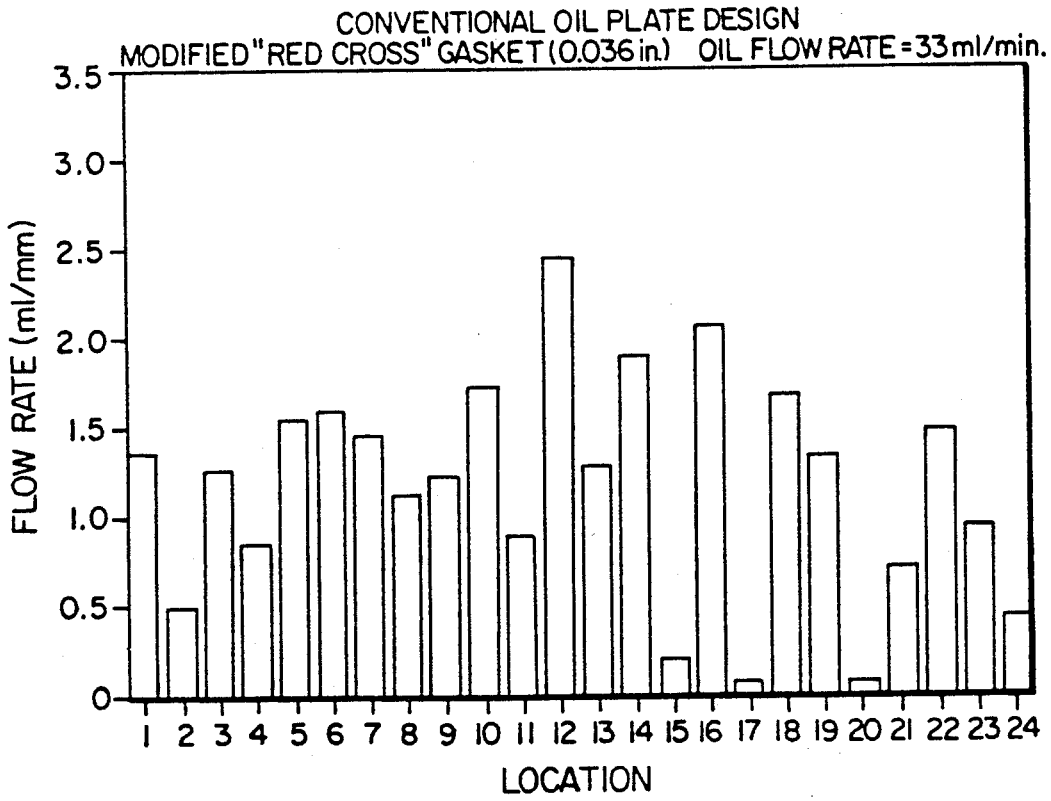
Figure 7:
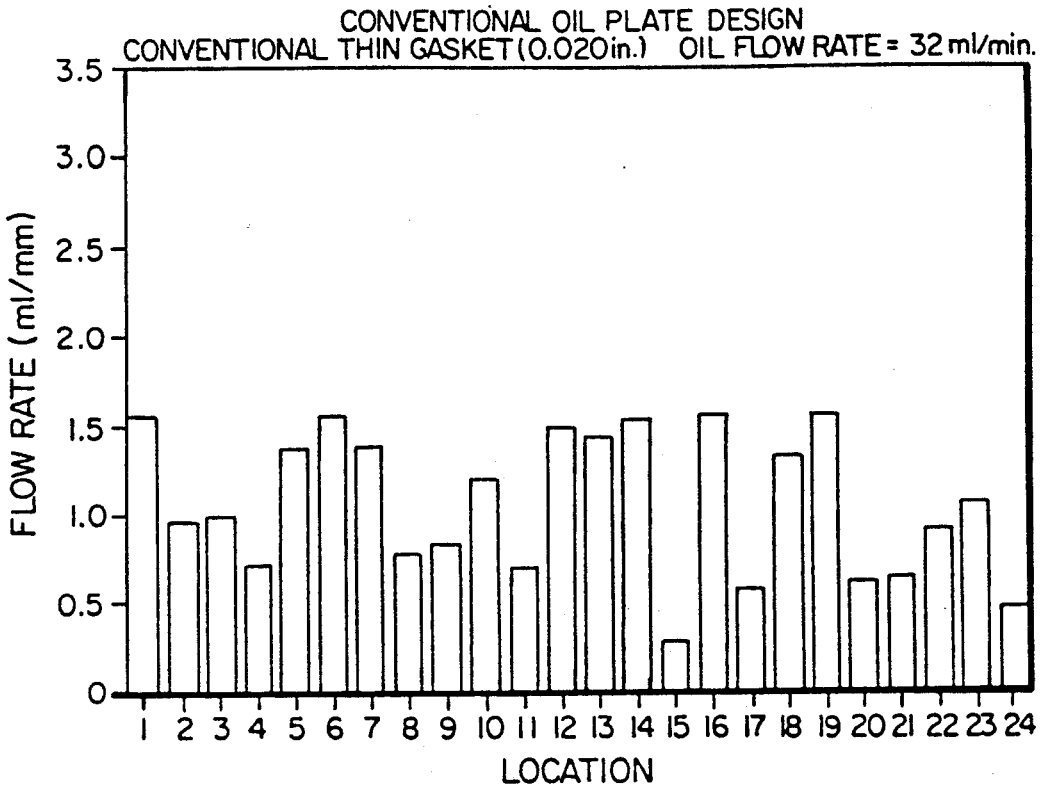
Figure 8:
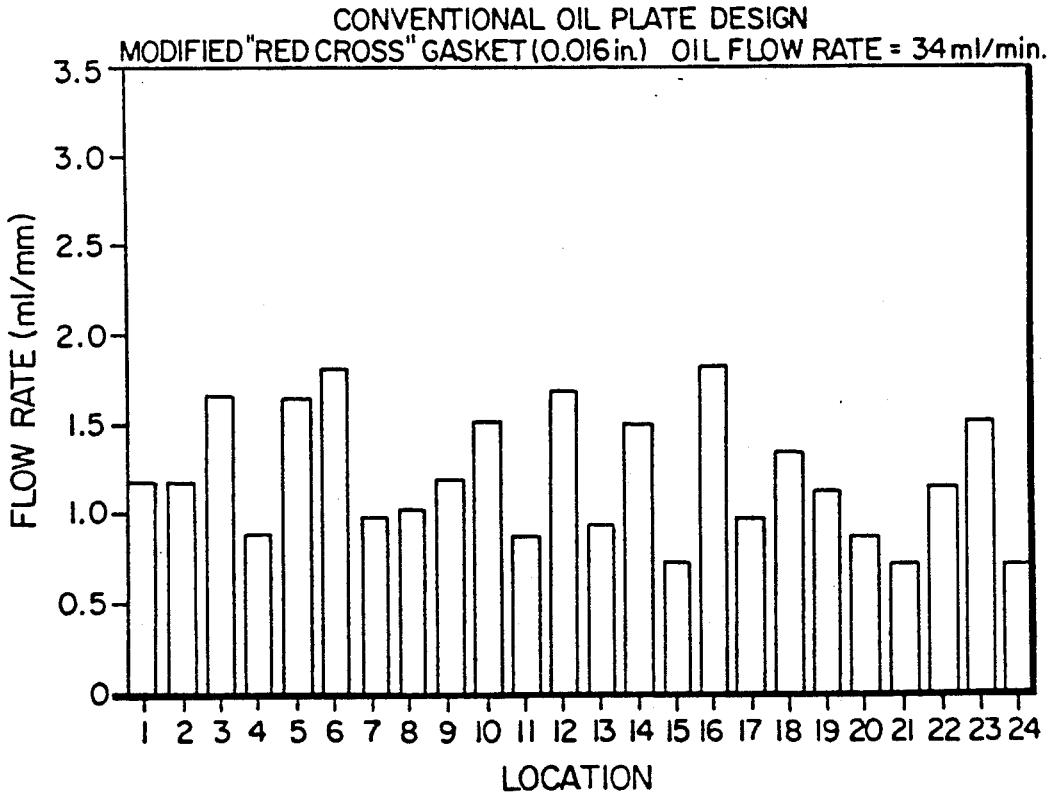
Figure 9:
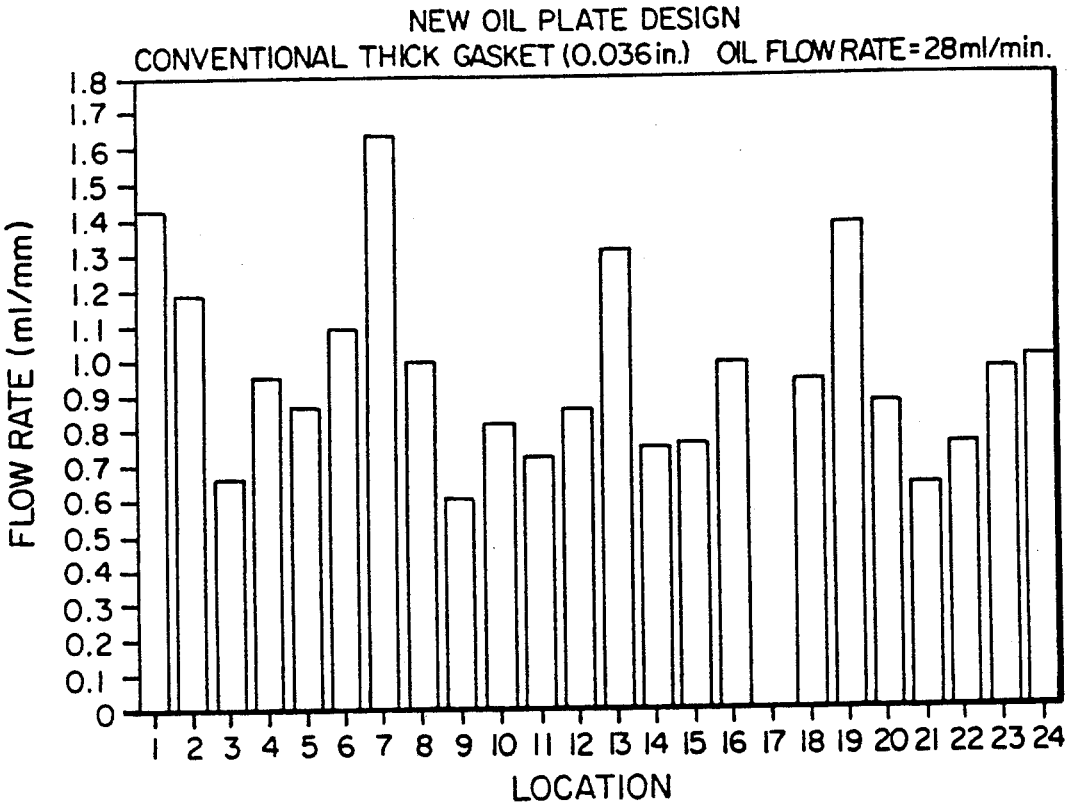
FIGS. 9 to 12 are bar graphs showing the measured flow rates using a plate design incorporating the present invention in combination with different thicknesses of a conventional gasket and of a gasket modified in accordance with the present invention.

Tests of flow distribution of lubricating oil using a prior art plate of conventional design in combination with a conventional gasket and a gasket constructed in accordance with the present invention are shown in FIGS. 5 to 8. As shown in FIGS. 5 and 6 when the gasket was thick neither the conventional (FIG. 5) nor the modified gasket of the present invention (FIG. 6) were particularly effective in producing uniform flow over the perimeter of the mold. The conventional thin gasket (FIG. 7) also was not particularly satisfactory, though it is significantly better than the thick gasket. The use a thin gasket of the present invention resulted in a significantly more uniform flow distribution (FIG. 8.)

Figure 10:
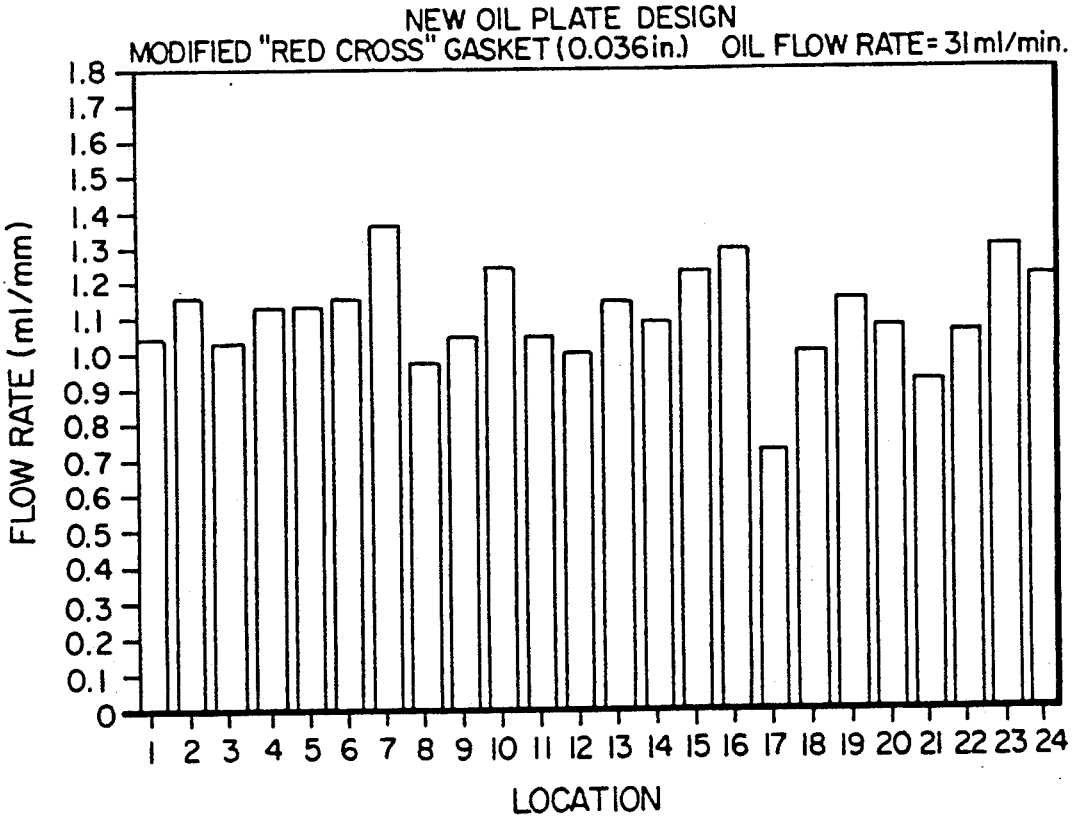
Figure 11:
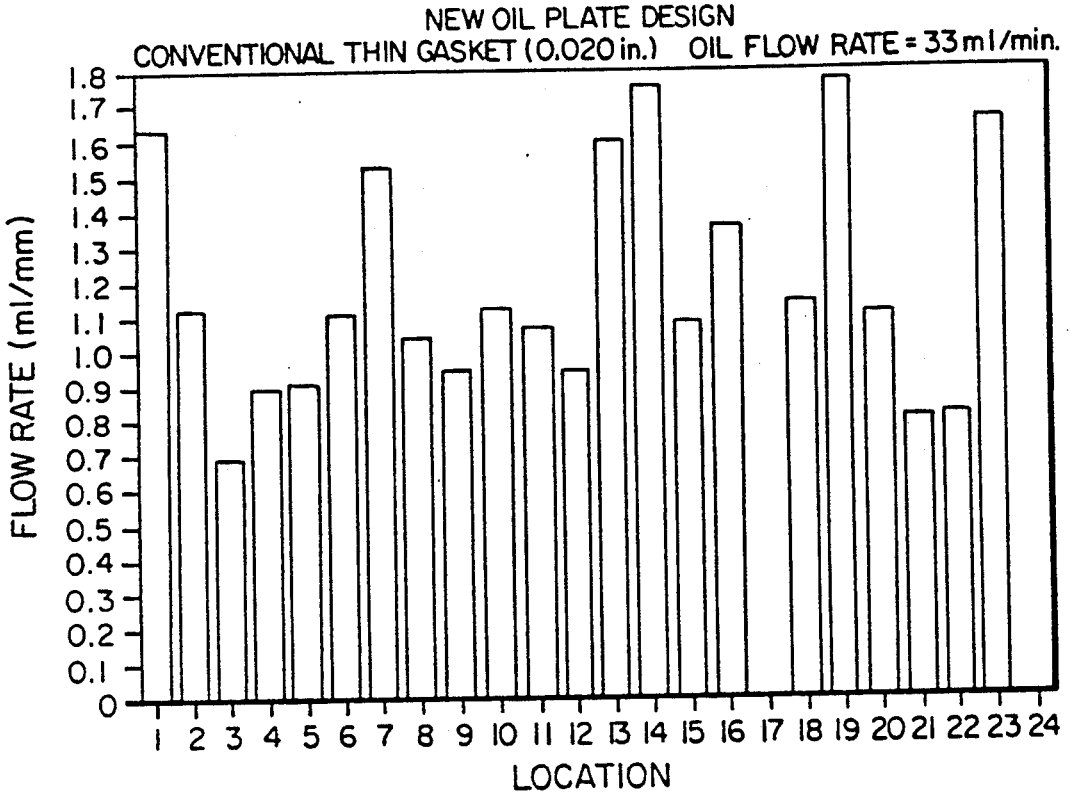
Figure 12:
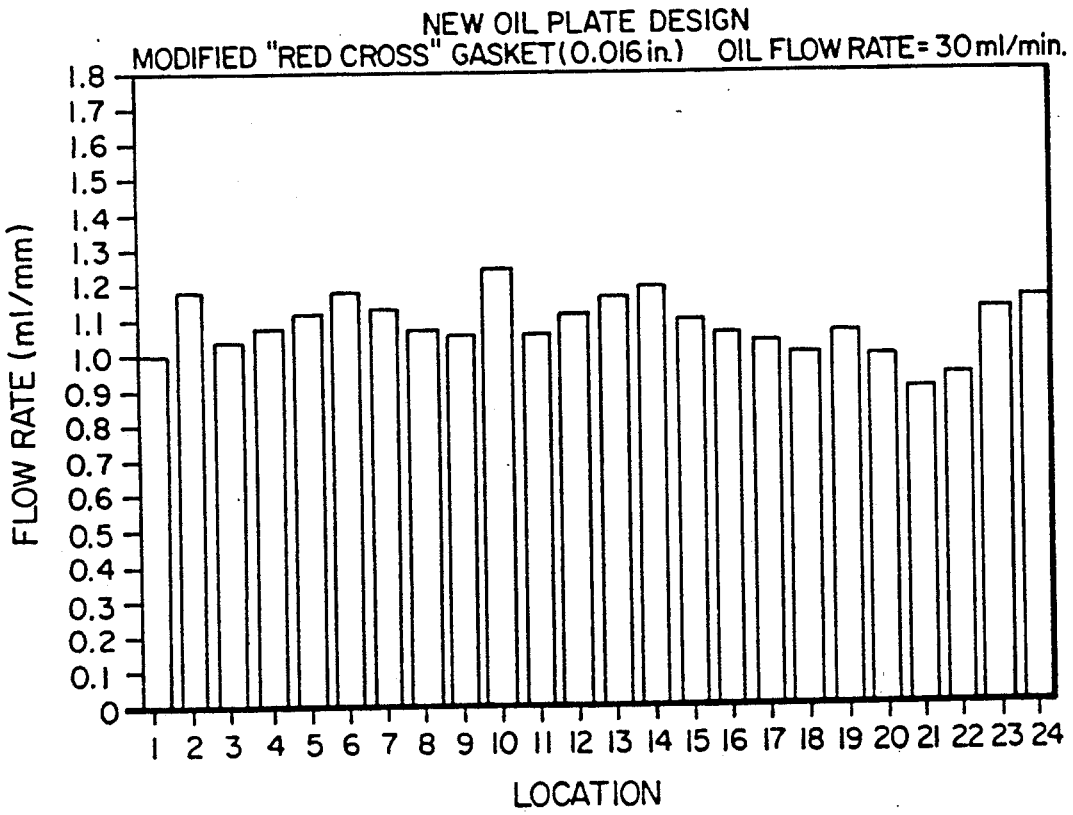

The tests using the plates of the present invention in FIGS. 9 to 12 indicate that with the conventional gasket whether thick (FIG. 9) or thin (FIG. 11) the flow distribution was nonuniform. When a gasket constructed in accordance with the present invention was used even when the gasket was thick a significant improvement in flow uniformity was attained (FIG. 10.) When the preferred construction of the present invention incorporating the thin gasket of the present invention with the plate structure of the present invention as described above was used a very uniform distribution of oil around the perimeter of the mold was obtained (FIG. 12.)

While the surfaces 36 and 38 of the gap 40 have been described as being parallel they may converge slightly as they approach the passage 18, and the term substantially parallel as used herein is intended to include such convergence. Converging the surfaces increases the cost of the system and thus normally will not be used.

The disclosure has referred to a gasket 40, however, other suitable shaped spacers may be used to define the height of the gap 42, for example a shaped spacer may be formed on one or both of the surfaces 36 and/or 38 by machining or a suitable shim may be used.

Having described the invention modifications will be evident to those skilled in the art without departing from the spirit of the invention as defined in the appended claims.

We claim:

1. In a continuous casting mold with a substantially rectangular cross section a device for delivering lubricating fluid to surfaces of side walls of a mold cavity comprising means defining a first annular surface encircling said mold cavity and extending substantially perpendicular to a longitudinal axis of said mold cavity, a second annular surface in spaced facing relationship to said first surface and cooperating with said first surface to define therebetween an annular lubricant gap surrounding and opening into said mold cavity around the complete circumference of said mold cavity to uniformly deliver lubricant to all of said side walls, an annular manifold extending in surrounding relationship around said mold cavity, an annular flow passage means connecting said manifold with said lubricant gap around the full periphery of said annular manifold, said passage means extending around the circumference of said mold cavity with an edge of said flow passage means closest to said mold cavity being spaced from said mold cavity at a substantially constant distance around the full periphery of said mold cavity for delivery of lubricant into said gap from said manifold on all sides of said mold cavity at a uniform spacing from said mold cavity on all sides of said mold cavity, said gap defining means for providing a resistance to flow of lubricant significantly greater than the resistance to flow of lubricant in said manifold and through said annular flow passage means, said gap between said flow passage means and the adjacent of said side walls of said mold passage having substantially equal resistance to flow of said lubricant whereby said lubricant is substantially uniformly distributed around the perimeter of said mold cavity and is applied equally and uniformly to each of said side walls.

2. A device as defined in claim 1 wherein said first surface is formed on a first annular element and said second surface is formed on a second annular element, a shaped spacer interposed between said first and second elements to define the spacing between said first and second surfaces and thereby the height of said lubricant gap.

3. A device as defined in claim 1 wherein said shaped spacer is a gasket interposed between said first and second elements.

4. A device as defined in claim 3 wherein said gasket defines said flow passage means between said manifold and said lubricant gap.

5. A device as defined in claim 4 wherein said gasket is shaped to divide said lubricant gap into four separate lubricant passages one extending to each said side of said mold cavity, each said lubricant passage having a substantially constant width equivalent to substantially the length of its adjacent of said sides of said mold cavity measured in a radial plane perpendicular to said longitudinal axis.

6. A device as defined in claim 5 wherein said first and said second surfaces are planar surfaces and are substantially parallel.

7. A device as defined in claim 6 wherein each said separate lubricant passage has a substantially constant width along its full length from said flow passage means to its adjacent of said sides of said mold cavity.

8. A device as defined in claim 3 wherein said gasket is shaped to divide said lubricant gap into four separate lubricant passages one extending to each side of said molding passage, each said lubricant passage having a substantially constant width equivalent to substantially the length of its adjacent of said sides of said mold cavity measured in a radial plane perpendicular to said longitudinal axis.

9. A device as defined in claim 8 wherein said first and said second surfaces are planar surfaces and are substantially parallel.

10. A device as defined in claim 9 wherein each said separate lubricant passage has a substantially constant width along its full length from said flow passage means to its adjacent of said sides of said mold cavity.

11. A device as defined in claim 3 wherein said first and said second surfaces are planar surfaces and are substantially parallel.

12. A device as defined in claim 1 wherein means divides said lubricant gap into four separate lubricant passages one extending to each of said sides of said mold cavity, each said lubricant passage having a substantially constant width equivalent to substantially the length of its adjacent of said sides of said mold cavity measured in a radial plane perpendicular to said longitudinal axis.

13. A device as defined in claim 12 wherein said first and said second surfaces are planar surfaces and are substantially parallel.

14. A device as defined in claim 13 wherein each said separate lubricant passage has a substantially constant width along it full length from said flow passage means to its adjacent of said sides of said mold cavity.

15. A device as defined in claim 1 wherein said first and said second surfaces are planar surfaces and are substantially parallel.

* * * * *